US011358692B2

(12) United States Patent
Weinrich et al.

(10) Patent No.: US 11,358,692 B2
(45) Date of Patent: Jun. 14, 2022

(54) PROPELLER FOR A WATER VEHICLE

(71) Applicant: promarin Propeller und Marinetechnik GmbH, Erftstadt (DE)

(72) Inventors: Bernd Weinrich, Bruehl (DE); Yannick Eberhard, Huerth (DE); Jan Breuers-Dressler, Cologne (DE)

(73) Assignee: promarin Propeller und Marinetechnik GmbH, Erftstadt (DE)

( * ) Notice: Subject to any disclaimer, the term of this patent is extended or adjusted under 35 U.S.C. 154(b) by 169 days.

(21) Appl. No.: 16/631,237

(22) PCT Filed: Jul. 17, 2018

(86) PCT No.: PCT/EP2018/069327
§ 371 (c)(1),
(2) Date: Jan. 15, 2020

(87) PCT Pub. No.: WO2019/016171
PCT Pub. Date: Jan. 24, 2019

(65) Prior Publication Data

US 2020/0216158 A1 Jul. 9, 2020

(30) Foreign Application Priority Data

Jul. 21, 2017 (DE) ..... 102017116516.9

(51) Int. Cl.
*B63H 1/26* (2006.01)
*B63H 1/14* (2006.01)
*B63H 1/20* (2006.01)

(52) U.S. Cl.
CPC ..... *B63H 1/26* (2013.01); *B63H 1/14* (2013.01); *B63H 1/20* (2013.01); *B63H 2001/145* (2013.01)

(58) Field of Classification Search
CPC ... B63H 1/26; B63H 1/14; B63H 1/20; B63H 2001/145
See application file for complete search history.

(56) References Cited

U.S. PATENT DOCUMENTS 1,463,441 A * 7/1923 Pike ..... B63H 1/26 416/200 R
3,006,603 A 10/1961 Caruso et al.
(Continued)

FOREIGN PATENT DOCUMENTS

CN 105 366 017 A 3/2016
DE 914 224 6/1954
(Continued)

OTHER PUBLICATIONS

Carlton, John, "Propeller Geometry" Marine propellers and propulsion, Chapter 3, 3. ed. Amsterdam: Elsevier, 2012 (Marine engineering), pp. 29-46.—ISBN 978-0-08-097123-0. (2nd edition: pp. 33-50.
(Continued)

*Primary Examiner* — Brian P Wolcott
(74) *Attorney, Agent, or Firm* — Muirhead and Saturnelli, LLC

(57) ABSTRACT

A propeller for a water vehicle is provided, comprising a hub and at least two blades, said blades extending outwards from the hub in the radial direction, and the propeller having a uniform blade distribution. The problem addressed by the invention is to provide a propeller for a water vehicle which allows unwanted generation of noise to be efficiently reduced or avoided. According to the invention, the angular distance between the blade tips of two consecutive blades of the propeller varies in relation to the angular distance between the blade tips of two other consecutive blades.

20 Claims, 8 Drawing Sheets

(56) References Cited

U.S. PATENT DOCUMENTS

| | | | | |
|---|---|---|---|---|
| 3,565,544 | A * | 2/1971 | Marshall | B63H 3/008 416/89 |
| 4,073,601 | A * | 2/1978 | Kress | B63H 1/26 416/223 R |
| 4,253,800 | A | 3/1981 | Segawa et al. | |
| 4,514,146 | A * | 4/1985 | Nojiri | B63H 1/14 416/175 |
| 5,096,382 | A | 3/1992 | Gratzer | |
| 5,096,383 | A * | 3/1992 | Dobrzynski | B64C 11/00 416/200 R |
| 5,779,440 | A | 7/1998 | Stricker et al. | |
| 6,371,726 | B1 * | 4/2002 | Jonsson | B63H 1/24 416/131 |
| 6,796,858 | B2 * | 9/2004 | Dusablon | B63H 11/08 415/199.4 |
| 7,090,550 | B2 | 8/2006 | Wilkie | |
| 9,328,613 | B2 * | 5/2016 | Lehmann | B63H 5/10 |
| 9,777,743 | B2 * | 10/2017 | Yang | F04D 29/281 |
| 2004/0235368 | A1 | 11/2004 | Lecours | |
| 2021/0070410 | A1 * | 3/2021 | Russell | B63H 1/20 |

FOREIGN PATENT DOCUMENTS

| | | |
|---|---|---|
| GB | 10811 | 11/1910 |
| GB | 07070 A | 12/1912 |
| GB | 4977 | 12/1915 |
| GB | 325538 | 2/1930 |
| GB | 521868 | 6/1940 |
| JP | S 61-64600 | 4/1986 |
| KR | 10 2011 0 019 271 A | 2/2011 |
| KR | 10-201-10041096 | 4/2011 |
| KR | 10 2012 0116098 A | 10/2012 |
| KR | 10 1 523 920 B1 | 6/2015 |
| WO | WO 2016/113599 A1 | 7/2016 |

OTHER PUBLICATIONS

G. Kuiper, The Wageningen Propeller Series, May 1992, pp. 15-31.
Wikipedia entry "Skew (Hydrodynamik)", retrieved Dec. 15, 2016 (Machine Translation).
Stefan Krueger, Schiffspropeller (lecture notes—Harburg Polytechnic, 2005), pp. 2, 10 (Machine Translation).
DNV GL, Rules for Classification: Inland navigation vessels, Pt. 4, Ch. 1, Section 2, pp. 34-37.
ABS (American Bureau of Shipping), Rules for Building and Classing Steel Vessels for Service on Rivers and Intracoastal Waterways 2007, Houston 2006, pp. 239-240.
Germanischer Lloyd (guidelines), Hamburg 2004, Pt I.1, Ch. 2, Section 6, pp. 6-1 to 6-3 (Machine Translation).
Germanischer Lloyd (guidelines), Hamburg 1997, Pt I.1, Ch. 2, Section 6, pp. 6-1 to 6-6 (Machine Translation).
J. Blaurock et al., Skew Back von Propellern, Hamburg 1984 (Machine Translation).

* cited by examiner

PROPELLER FOR A WATER VEHICLE

TECHNICAL FIELD

The system described herein relates to a propeller for a watercraft. In particular, the system described herein relates to a propeller with a rigid shaft, a rudder propeller, a pivotable drive or an outboard drive for a ship, boat or submarine.

BACKGROUND OF THE INVENTION

The system described herein relates both to a fixed propeller (fixed pitch propeller, FPP) and to an adjustable propeller (controllable pitch propeller, CPP). In the case of adjustable propellers, the blades are fastened, rotatably about an axis, to the hub. In this case, the geometrical specifications apply to the design point. Finally, so-called "build-up" propellers with rotatable blades are also known, in the case of which the blades are rotated and can be arrested in a particular rotational position by means of screws.

Furthermore, the propeller may be operated with and without a nozzle, shroud or partial shroud. The propeller may be used as a tractor propeller or pusher propeller.

In the case of propellers being used for driving watercraft, it is known that the pressure waves or pressure pulses generated by the individual blades can lead to resonant vibration excitation of the watercraft and thus to undesired noise generation.

To prevent the generation of noise, it is known, inter alia, from US 2004/0 235 368 A1 to arrange the blades with different spacings on the circumference of the hub. It is also known from GB 521 868 A and U.S. Pat. No. 4,253,800 A for the blades or vanes of a propeller to be arranged so as to be distributed at irregular intervals over the circumference of the propeller. As a result of the irregular arrangement of the blades, the regularity of the pressure shocks transmitted by the blade tips of the propeller blades to the hull is broken up, and the harmonic excitation of the hull is reduced. At the same time, the propeller hereby loses its dynamic balance and can generate an imbalance. Imbalances and propulsion forces which vary over the propeller circumference can firstly impair effective propulsion and can secondly generate mechanical forces which can impair the service life of the marine drive and can in turn lead again to noise generation.

CN 105 366 017 A has disclosed a propeller which has a hub with first blades (primary blades) and second blades (secondary blades). The primary blades and secondary blades are distributed alternately and uniformly over the circumference of the hub. The length of the primary blades is considerably greater than, in particular twice as great as, the length of the secondary blades.

SUMMARY OF THE INVENTION

Embodiments of the present system described herein provides a propeller for a watercraft, the propeller blades of which are of substantially equal size and/or equal weight, and by means of which an undesired generation of noise can be reduced or prevented in an effective manner.

A propeller according to embodiments of the system described herein for a watercraft may include a hub and at least two blades, wherein the blades extend from the hub in an outward radial direction, and the propeller has a uniform blade separation. In other words, the angular spacing between the roots, situated on the hub, of the generatrices (blade generator lines) of two successive blades corresponds in each case to 360° divided by the number of blades. As in the case of conventional marine propellers, the blades may be distributed uniformly over the circumference of the hub. The angular spacing between the roots of the generatrices of two successive blades may amount to 180° in the case of a two-blade propeller, 120° in the case of a three-blade propeller, 90° in the case of a four-blade propeller, 72° in the case of a five-blade propeller, etc.

A desired reduction of the harmonic excitation may be achieved in that the angular spacing between the blade tips of two successive blades of the propeller may vary in relation to the angular spacing between the blade tips of two other successive blades.

In other words, the blade tips may be distributed irregularly over the circumference of the propeller. The angle between two successive blade tips in the direction of rotation of the propeller may vary at least in relation to the angle between two other successive blade tips. It is also possible for all angles between in each case two successive blade tips to be different.

The propeller noises result from forced harmonic vibrations, in particular from the periodic excitation by the individual propeller blades via the hull of the ship. The critical region may be considered in this case the position above the propeller. An intense negative-pressure area prevails at the blade tip of the propeller owing to the cavitating tip vortex and the foil effect of the propeller. This negative-pressure area propagates as a pressure wave through space and strikes the hull. As a result of the variation of the spacings of the blade tips of successive blades, the time interval from pressure wave to pressure wave of two successive blades varies. In this way, the harmonic excitation is disrupted, and it is even possible to realize excitations which attenuate one another. It is to be pointed out here that, in the field of propeller construction, the expression "blade tip" can have different meanings. "Blade tip" can refer to that point of the blade which has the greatest radial spacing to the axis of rotation of the propeller, or to that point of the blade at which the radially running tangent meets the trailing side of the blade. In this description, the expression "blade tip" refers to the location which generates the most intense negative-pressure area. The tip vortex of the blade normally arises at this location.

In the case of a two-blade propeller, the angular spacing between the first blade tip and the second blade tip consequently may be different than the angular spacing between the second blade tip and the first blade tip. In other words, the angular spacing between the two blade tips may deviate from 180°. In the case of propellers with more blades, there are further possibilities for variation of the angular spacing, as will be discussed below.

By means of the aperiodic pressure pulses, a situation is prevented in which the watercraft is subjected to excitation with a constant frequency, which in the worst case lies close to the natural frequency of the watercraft. The propeller according to the system described herein consequently may reduce or prevent the resonant vibration excitation of the watercraft, which would result in an increase of the vibration amplitude and thus an increase in the sound intensity. The noise generation caused by the propeller may be significantly reduced.

As mentioned above, the irregular spacings of the blade tips apply, in the case of adjustable propellers, for the design point, that is to say the blade position which is provided for the constant normal operation of the propeller.

A radial straight line leading from the central point of the hub through the root of the blade profile adjoining the hub is commonly referred to as propeller reference line (propeller generator line). In the case of propellers known from the prior art, the propeller is constructed such that a blade is fixed in relation to the propeller reference line, and further blades are arranged in accordance with this construction on the hub by virtue of the propeller reference line, in each case being rotated about the propeller axis by the angle of the blade separation. In the case of a propeller according to the system described herein, at least one blade may have a course which deviates, with respect to the propeller reference line, in relation to another blade. In this respect, the expression "propeller reference line" does not apply here. For this application, the radially running connecting line between the central point of the hub (the axis of rotation) and the root of the profile, adjoining the hub, of a blade is referred to as radial straight line through the root.

The centers of mass of all blades may have the same radial spacing to the hub. This has a positive effect on the concentricity of the propeller, and imbalances are avoided. If the center of mass of all blades of the propeller lies in the same axial plane and additionally has the same radial spacing to the hub, the axis of rotation and the main axis of inertia of the propeller coincide, and static and dynamic imbalances are avoided.

Alternatively or in addition, all blades have the same weight.

The different spacings of successive blade tips may be realized in practice by means of different profile courses of the successive blades. The blades of marine propellers are generally constructed, in a radial direction proceeding from the hub, as a sequence of successive blade profile sections. The blade profile sections of a blade generally have chord lengths, angles of attack and thicknesses which vary in an outward direction from the hub. Every blade profile section is generally determined on a cylindrical area about the propeller axis. A detailed description of the characteristics and construction features of propellers for the propulsion of watercraft can be found in chapter 3 of the book "Marine Propellers and Propulsion", 3rd edition, by the author: John Carlton, ISBN: 9780080971230, which is hereby incorporated into the subject matter of the present description.

The blades of current propellers generally have a blade tilt, also referred to as skew. This means that the centers of gravity of the blade profile sections in the propeller plane are shifted in relation to a radial straight line through the root, wherein the root is the center of gravity of the innermost blade profile section adjoining the hub. The sequence of centers of gravity of all blade profile sections from the hub to the maximum circumference of the propeller is the generatrix of the blade (blade generator line). In the case of blades without skew, the generatrix runs in a straight manner in a radial direction. In the case of skew, the blade profile sections are shifted relative to the radial straight line through the root. The radial profile of the shift may be varied.

Skew is generally measured as an angle in the projected view, that is to say in the plan view, onto the propeller plane in an axial direction. In the above-cited book, John Carlton defines a skew angle as the greatest angle, measured at the hub axis, in the projected view or plan view between two lines which run from the hub axis to the generatrix of the blade. This is commonly the angle, in the plan view, between the leading-side tangent to the generatrix and the trailing-side point of departure of the generatrix from the blade profile. According to another definition, the skew angle is measured in the projected view between the radial tangent, running through the propeller axis, to the generatrix and the radial tangent to the trailing edge of the blade. Common values for the skew angle nowadays are 30° to 50°, but may be higher. In a departure from the skew angle, according to G. Kuiper "The Wageningen Propeller Series", a skew distribution exists in which the radial course of the local profile skew is defined. Here, it is also possible to select different radial distributions of the skew course in the case of the same skew angle. In the case of so-called "balanced skew", the inner blade profile sections close to the hub are shifted in a direction of rotation in relation to the radial straight line through the root (chord center of the blade profile section adjoining the hub). The blade thus has forward tilt in this region. The shift varies in continuous fashion, wherein the generatrix intersects the radial straight line through the root and then extends further backward, such that backward tilt exists in the outer region of the blade. In the case of current designs, the generatrix intersects the straight line through the root at a value of 0.7 of the radial extent of the blade.

However, so-called "biased skew" is also known, in the case of which the blade profile portions have, proceeding from the hub, a backward tilt, that is to say are shifted counter to the direction of rotation relative to the radial straight line through the root. Here, the advantages of the Carlton definition of skew are evident because an effective tangent to the generatrix does not exist. The blade tips of blades with the same skew angle but different skew course can thus be situated at different angular positions in the projected view of the propeller. A shift in the direction of rotation is also possible, and is generally referred to as "backward skew".

In practice, at least two blades of the propeller may have a different course of the blade tilt [skew]. Here, the two blades may have different skew angles. In addition or alternatively, the two blades may have different curvatures of the generatrices. Only propellers in which the individual blades have substantially identical shapes have hitherto been known. The proposal of covering the blades with identical or similar profile sections, but different courses of the blade skew, makes it possible to create blades with very similar hydrodynamic characteristics which nevertheless have, in the case of each blade, a different position of the blade tip in relation to the radial straight line through the root of the generatrix. In this way, the harmonic excitations caused by the propeller may be reduced, but a balanced design can nevertheless be realized.

The course of the generatrix of a first blade may deviate from the course of the generatrix of the at least one further blade. This yields a different course of the skew, which leads to a shift of the blade tip.

In order to identify different skews in the blades of a propeller, it suffices to measure the angle, in the projected plane, between the tangent to the leading edge and the tangent to the trailing edge. The determined angle duly does not correspond to the definition of skew but makes it possible to identify courses of the blade shape which are changed from blade to blade.

At least two blades may, in practice, have different extents in a radial direction. Also, in practice, the course of the pitch of the first blade from the root to the blade tip may deviate from the course of the pitch of the at least one further blade.

If a blade has a very small degree of skew, the pressure pulses induced by the tip vortices are more intense. To reduce the pulses, the blade tips may be relieved of load. This means that the pitch at the blade tip may be reduced (profile angle of attack is reduced). As a result, the pressure pulses decrease in magnitude, because less thrust is generated at the tip. If one relieves the tip of load, the pitch at lower blade profile sections should be increased, because only in this way is it possible to ensure an unchanged consumption of power by the various blades.

If the propeller has an even number of blades greater than two, mutually oppositely situated blades may be of identical form. It may be ensured in this way that mutually oppositely situated blades generate no mass imbalance, and have the same hydrodynamic characteristics. Owing to the deviating blade shape of the blades arranged between the mutually diametrically oppositely situated blades, a constant frequency of the pressure pulses that occur is avoided.

Alternatively, or in the case of an uneven number of blades, it is also possible for all blades to have mutually deviating positions of the blade tips. This arrangement may yield a particularly high degree of deviation from a harmonic pressure excitation, but structural measures should be implemented in order to maintain the balance of the propeller.

In order to avoid static and dynamic imbalances, the course of the blade rake may be adapted to the course of the blade skew. Variations in the course of the blade skew and the pitch of the individual blades which cause the variation in the position of the blade tip may be compensated by virtue of the course of the blade rake, that is to say the profile shift in the direction of the propeller axis, being adapted such that the entire propeller is balanced.

The variation of the skew and thus of the course of the generatrix of the different blades may result in different lengths of the generatrices. The resulting increase in weight may, for example, be compensated by virtue of the chord lengths or the profile thicknesses of the individual blade profile sections in their different radial profile sections being varied.

The spacing of the blade tips of two successive blades may be selected such that, at the design point, the pressure pulses generated by the different blade tips at least partially attenuate one another upon striking the hull.

At the design point, that is to say, in the case of a rigid propeller, at the rated rotational speed and, in the case of an adjustable propeller, at the rated rotational speed and at the blade angle of attack predefined for continuous operation, it is consequently the case that not only the constant frequency of the pressure pulses may be eliminated. The pressure pulses caused by successive blade tips may follow one another such that they at least partially attenuate one another in the hull.

The spacing of the blade tips of two successive blades may be selected such that, at the design point, the pressure pulse counteracts the vibration of the hull.

BRIEF DESCRIPTION OF THE DRAWINGS

Practical embodiments of the system described herein are described below in conjunction with the appended drawings, in which.

DESCRIPTION OF VARIOUS EMBODIMENTS

Figure 1:
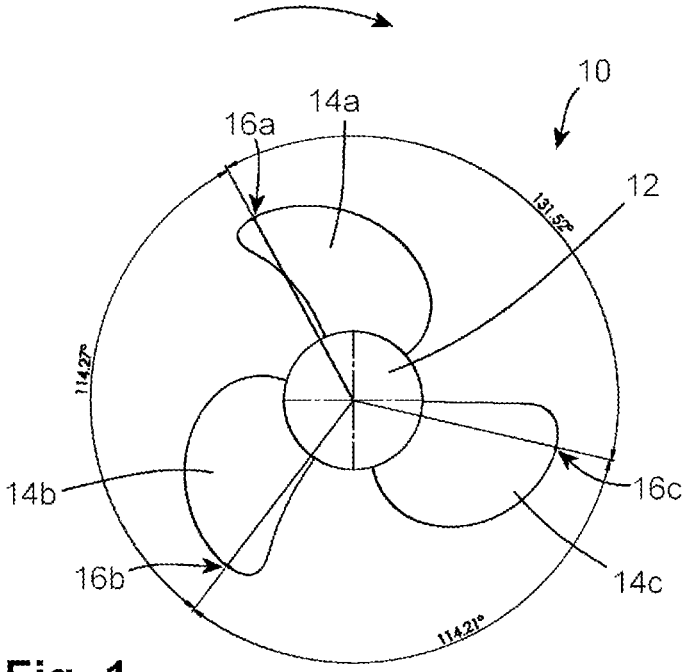
FIG. 1 shows a first embodiment of a propeller according to an embodiment of the system described herein with three blades in a plan view onto the propeller plane.

FIG. 1 illustrates a propeller 10 for a watercraft in a first embodiment of the system described herein. In the present case, the propeller 10 is illustrated in a plan view onto the propeller plane in the direction of the axis of rotation of the propeller 10. The axis of rotation of the propeller 10 consequently extends into the plane of the drawing.

The propeller 10 has a hub 12, which is illustrated only schematically. In the present case, three blades 14*a*, 14*b*, 14*c* extend in a radial direction from the hub 12.

The blades 14*a*, 14*b*, 14*c* have a respective blade tip 16*a*, 16*b*, 16*c*, wherein the blade tip 16*a*, 16*b*, 16*c* is defined as location which generates the most intense negative-pressure area and at which the tip vortex of the blade 14*a*, 14*b*, 14*c* arises. In the embodiment shown, the blade tips 16*a*, 16*b*, 16*c* are in each case the center of gravity of the radially outermost profile section. As mentioned above, a profile section is in each case a section through the blades 14*a*, 14*b*, 14*c* which lies on a cylindrical surface.

The angular spacing between the respective blade tips 16*a*, 16*b*, 16*c* of the blades 14*a*, 14*b*, 14*c* may vary. In the embodiment shown here, the angular spacing between the first blade tip 16*a* of the first blade 14*a* and the second blade tip 16*b* of the second blade 14*b* amounts to 114.27°. The angular spacing between the second blade tip 16*b* and the third blade tip 16*c* likewise amounts to 114.21°, and the angular spacing between the third blade tip 16*c* and the first blade tip 16*a* amounts to 131.52°.

Figure 2:
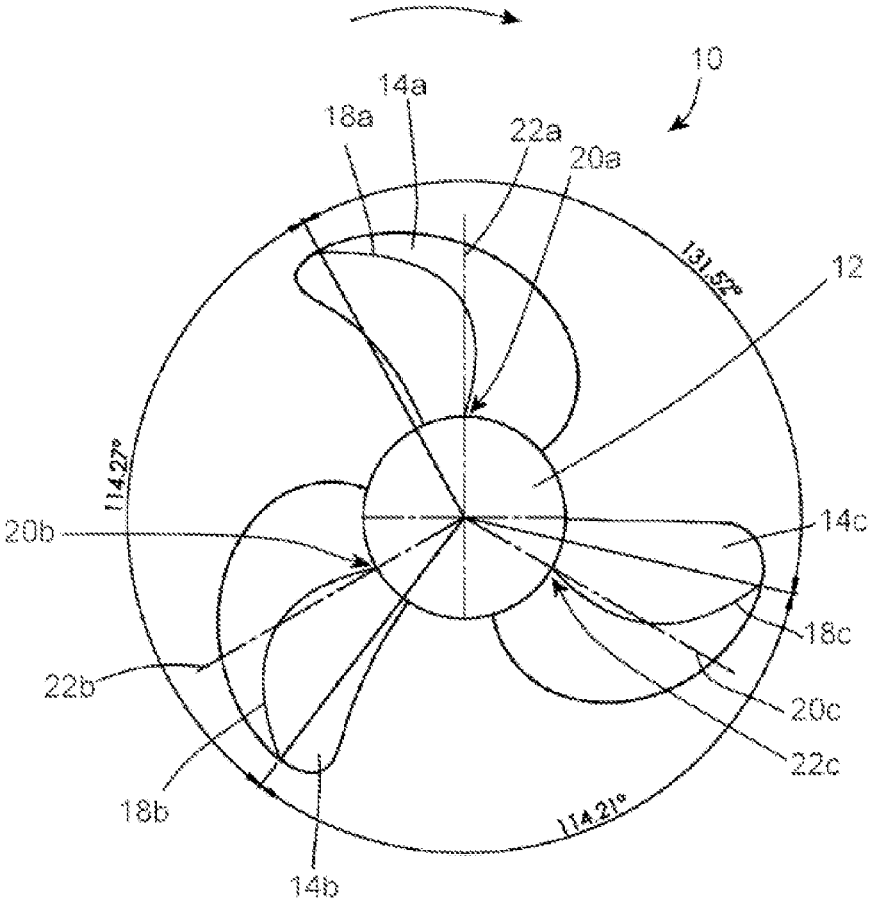
FIG. 2 shows the first embodiment from FIG. 1 with plotted generatrices and radial straight lines through the roots, according to an embodiment of the system described herein.

FIG. 2 shows the propeller 10 from FIG. 1 once again, wherein in each case one generatrix 18*a*, 18*b*, 18*c* is additionally shown here. The generatrix 18*a*, 18*b*, 18*c* connects in each case the centers of gravity of the individual profile sections of the corresponding blade 14*a*, 14*b*, 14*c*.

The region in which the blades 14*a*, 14*b*, 14*c* are attached to the hub 12 is the root region. The center of gravity of the radially innermost profile section is also referred to as root point 20*a*, 20*b*, 20*c*. In FIG. 2, aside from the generatrices 18*a*, 18*b*, 18*c*, a radial straight line 22*a*, 22*b*, 22*c* through the root 20*a*, 20*b*, 20*c* is also shown (dashed line), which runs in each case orthogonally with respect to and through the axis of rotation of the propeller 10 and through the root 20*a*, 20*b*, 20*c* of the respective blade 14*a*, 14*b*, 14*c*. The angular spacing of the radial straight lines 22*a*, 22*b*, 22*c* through the root 20*a*, 20*b*, 20*c* denotes the blade separation. The blade separation may be uniform, that is to say the angular spacing of the radial straight lines 22*a*, 22*b*, 22*c* through the root 20*a*, 20*b*, 20*c* may be equal between all successive blades 14*a*, 14*b*, 14*c*. For example, in the case of three blades 14*a*, 14*b*, 14*c*, the angular spacing between two successive radial straight lines 22*a*, 22*b*, 22*c* through the root 20*a*, 20*b*, 20*c* is in each case 120°.

The radial straight line 22*a*, 22*b*, 22*c* through the root 20*a*, 20*b*, 20*c* and the generatrix 18*a*, 18*b*, 18*c* intersect at the root 20*a*, 20*b*, 20*c*. The blades 14*a*, 14*b*, 14*c* shown here are blades 14*a*, 14*b*, 14*c* with a so-called "balanced skew", that is to say the generatrix 18*a*, 18*b*, 18*c* extends in the direction of rotation relative to the radial straight line 22*a*, 22*b*, 22*c* through the root 20*a*, 20*b*, 20*c* in an inner radial portion, and extends counter to the direction of rotation relative to the radial straight line 22*a*, 22*b*, 22*c* through the root 20*a*, 20*b*, 20*c* in a radially outer portion. In an embodiment, the intersection point of the generatrix 18*a*, 18*b*, 18*c* of each blade 14*a*, 14*b*, 14*c* with the radial straight line 22*a*, 22*b*, 22*c* through the root 20*a*, 20*b*, 20*c* has a radial spacing to the propeller axis which corresponds to approximately 0.7 times the propeller radius.

The varying angular spacing between the blade tips 16*a*, 16*b*, 16*c* may be, in the first embodiment, caused by a different course of the generatrices 18*a*, 18*b*, 18*c* and a different skew angle.

Figure 3:
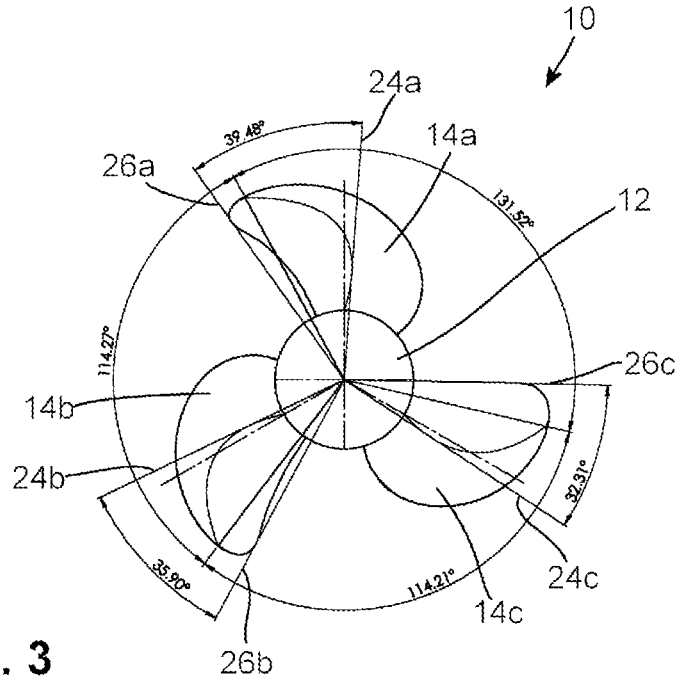
FIG. 3 shows the first embodiment from FIGS. 1 and 2 with indicated skew angles, according to an embodiment of the system described herein.

The skew angle is illustrated in FIG. 3. Although different definitions are also used in the literature, in the context of this application the skew denotes the angle between a tangent 24*a*, 24*b*, 24*c*, running radially with respect to the propeller axis, to the outermost or foremost point of the generatrix 18*a*, 18*b*, 18*c* in the direction of rotation, and a radial tangent 26*a*, 26*b*, 26*c* to the trailing edge of the respective blade 14*a*, 14*b*, 14*c*. In an embodiment, all three skew angles are different, for example, where the skew angle of the first blade 14*a* amounts to 39.48°, the skew angle of the second blade 14*b* amounts to 35.90°, and the skew angle of the third blade 14*c* amounts to 32.31°.

It is pointed out that a varying angular spacing of the blade tips 16*a*, 16*b*, 16*c* can also be achieved if, in the case of an equal skew angle, in each case only the course of the generatrices 18*a*, 18*b*, 18*c* of the three blades varies.

Figure 4:
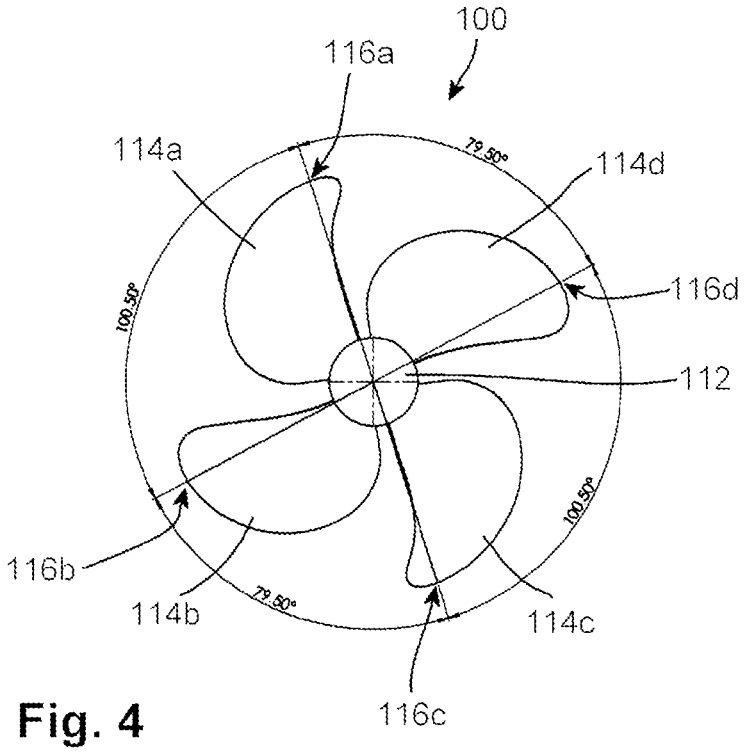
FIG. 4 shows a second embodiment of a propeller according to an embodiment of the system described herein with four blades in a plan view onto the propeller plane.

FIG. 4 illustrates a second embodiment of a propeller 100. Four blades 114*a*, 114*b*, 114*c*, 114*d* are arranged on the hub 112 of this second embodiment. The mutually diametrically oppositely situated blades 114*a*, 114*b*, 114*c*, 114*d* in each case may be of identical form, and one pair of diametrically oppositely situated blades 114*a*, 114*c* may differ from the other blade pair 114*b*, 114*d*. That is to say, the first blade 114*a* and the third blade 114*c* may have, with respect to the radial straight line through the root (not illustrated in FIG. 4), an identical course of the generatrices (not illustrated in FIG. 4) and likewise an identical skew angle. The same may apply to the second blade 114*b* and the fourth blade 114*d*, wherein their course of the generatrices and skew angles may deviate from those of the first blade 114*a* and of the third blade 114*c*.

The angular spacing between the first blade tip 116*a* and the second blade tip 116*b* and the angular spacing between the third blade tip 116*c* and the fourth blade tip 116*d* each may amount to 100.50°. The angular spacing between the second blade tip 116*b* and the third blade tip 116*c* and the angular spacing between the fourth blade tip 116*d* and the first blade tip 116*a* each may amount to 79.50°.

Figure 5:
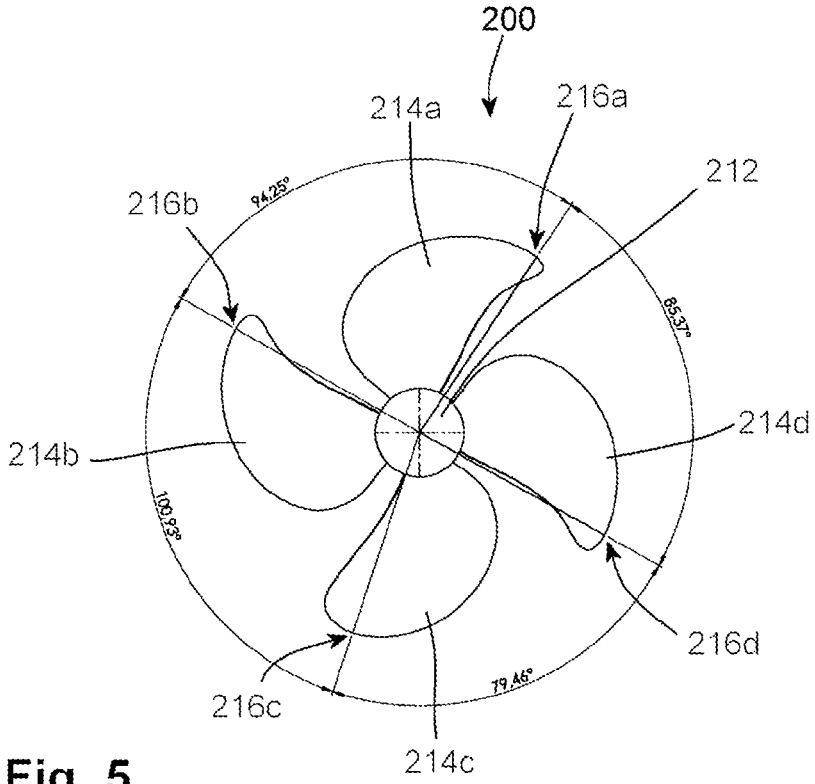
FIG. 5 shows a third embodiment of a propeller according to the an embodiment of the system described herein with four blades in a plan view onto the propeller plane.

FIG. 5 shows a third embodiment of a propeller 200, on the hub 210 of which there are likewise arranged four blades 214*a*, 214*b*, 214*c*, 214*d*. The four blades 214*a*, 214*b*, 214*c*, 214*d* may have in each case a different course of the generatrix in relation to the radial straight line through the root and a different skew angle.

In this third embodiment, each of the angular spacings between the individual blade tips 216*a*, 216*b*, 216*c*, 216*d* may be different. The angular spacing between the first blade tip 216*a* and the second blade tip 216*b* may amount to 100.93°. The angular spacing between the second blade tip 216*b* and the third blade tip 216*c* may amount to 79.46°. The angular spacing between the third blade tip 216*c* and the fourth blade tip 216*d* may amount to 85.37°, and the angular spacing between the fourth blade tip 216*d* and the first blade tip 216*a* may amount to 94.25°.

Figure 6:
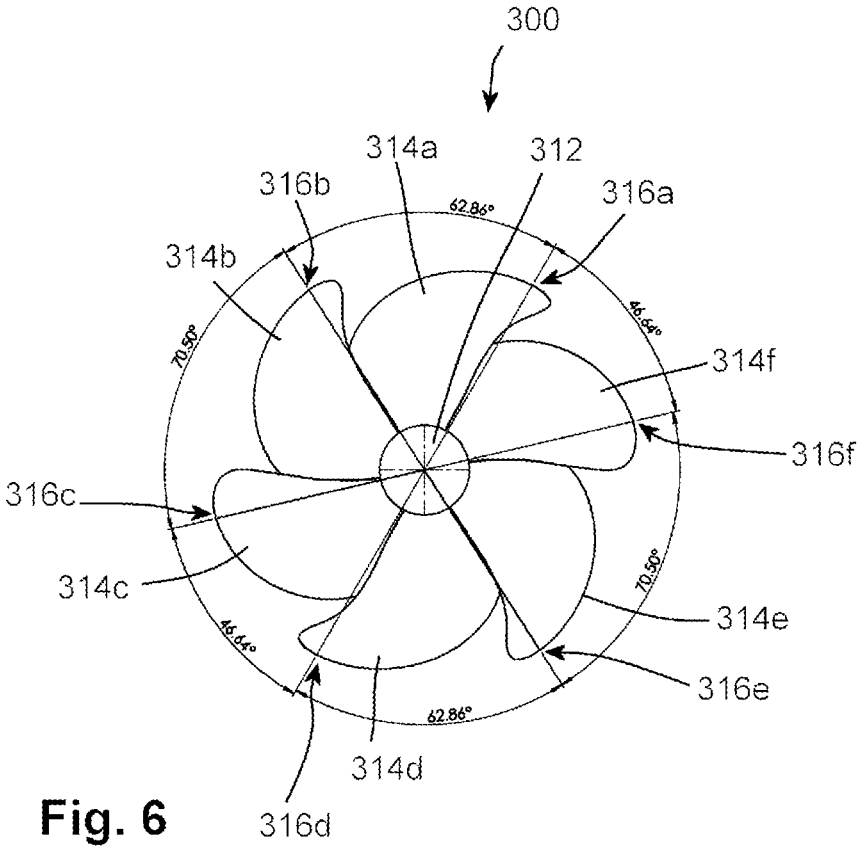
FIG. 6 shows a fourth embodiment of a propeller according to the an embodiment of system described herein with six blades in a plan view onto the propeller plane.

The fourth embodiment of a propeller 300 as shown in FIG. 6 has six blades 314*a*, 314*b*, 314*c*, 314*d*, 314*e*, 314*f*, which each extend in a radial direction proceeding from the hub 312. In each case two mutually diametrically oppositely situated blades may be of identical form. The angular spacing between the first blade tip 316*a* and the second blade tip 316*b*, and also between the fourth blade tip 316*d* and the fifth blade tip 316*e*, may amount to 62.86°. The angular spacing between the second blade tip 316*b* and the third blade tip 316*c*, and also the fifth blade tip 316*e* and the sixth blade tip 316*f*, may amount to 70.50°. The angular spacing between the third blade tip 316*c* and the fourth blade tip 316*d*, and also between the sixth blade tip 316*f* and the first blade tip 316*a*, may amount to 46.64°.

Figure 7:
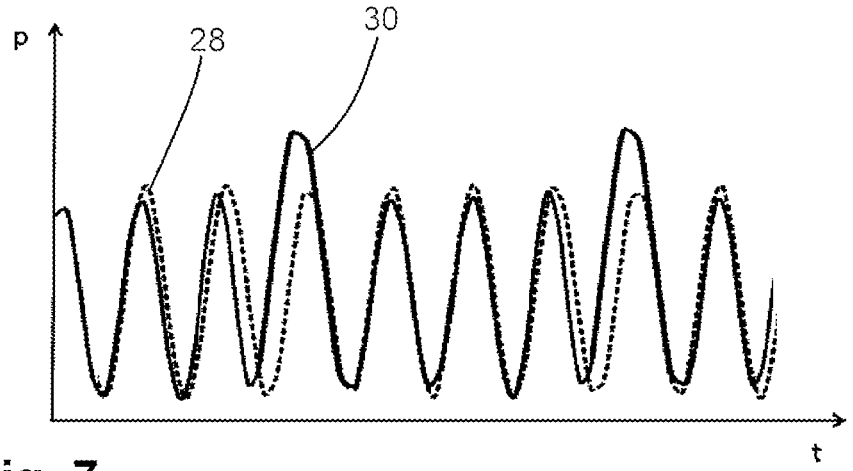
FIG. 7 shows a schematic illustration of generated pressure pulses, according to an embodiment of the system described herein.

FIG. 7 schematically shows a pressure course for two different propellers, according to an embodiment. The dashed line shows a pressure course 28 of a propeller known from the prior art with four identical blades. The successive blade tips have in each case the same angular spacing, and, in the case of a constant rotation speed, the maxima of the pressure pulses follow one another with the same frequency and amplitude. These pressure pulses cause highly uniform excitation of the hull. If the frequency of the pressure pulses caused by such a propeller with identical blades lies close to a natural frequency of the hull of the watercraft, then the hull is caused to perform a resonant vibration, and a considerable noise burden and dynamic loading of the hull can occur.

The solid line illustrates a pressure course 30 for an example of a propeller according to the system described herein with four blades. This could, for example, be a propeller according to the third embodiment, wherein the four blades have in each case different angular spacings.

As can be clearly seen, the maxima of the pressure pulses in the curve 30 occur aperiodically, and repeat only after one full revolution of the propeller. Furthermore, a different course of the generatrices and of the skew angles gives rise to a different magnitude of the pressure prevailing at the blade tip, and thus a different amplitude of the calculated signal. Thus, a uniform and in particular resonant excitation of a hull is avoided, and noise generation is counteracted in an effective manner.

The above description has discussed primarily the blade geometry of the propeller in the plan view onto the propeller plane in an axial direction. In this view, the angular spacing between the blade tips of successive blades of a propeller can be seen, which is of importance for the reduction of harmonic excitations of the hull. Design freedom exists with regard to the specification of other geometrical features of the propeller blades. For example, chapter 3 of the book "Marine Propellers and Propulsion", 3rd edition, by the author: John Carlton, ISBN: 9780080971230, describes the laws for the specification of the propeller and blade geometry. Below, on the basis of an example, geometry specifications will be discussed which define a functional and balanced propeller.

In order to realize a propeller with different angular spacings between the blade tips, the following process can be followed for each blade:

1. Establishing the Cylindrical Balance

Figure 8:
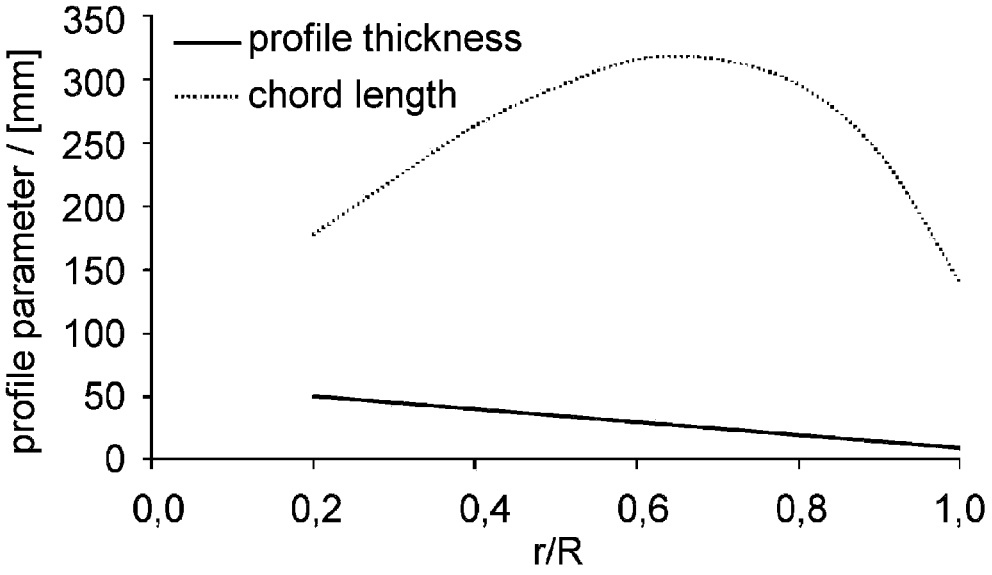
FIG. 8 shows a diagram of the course of the profile thicknesses and of the chord lengths of the radii sections of an exemplary blade profile, according to an embodiment of the system described herein.
Figure 9:
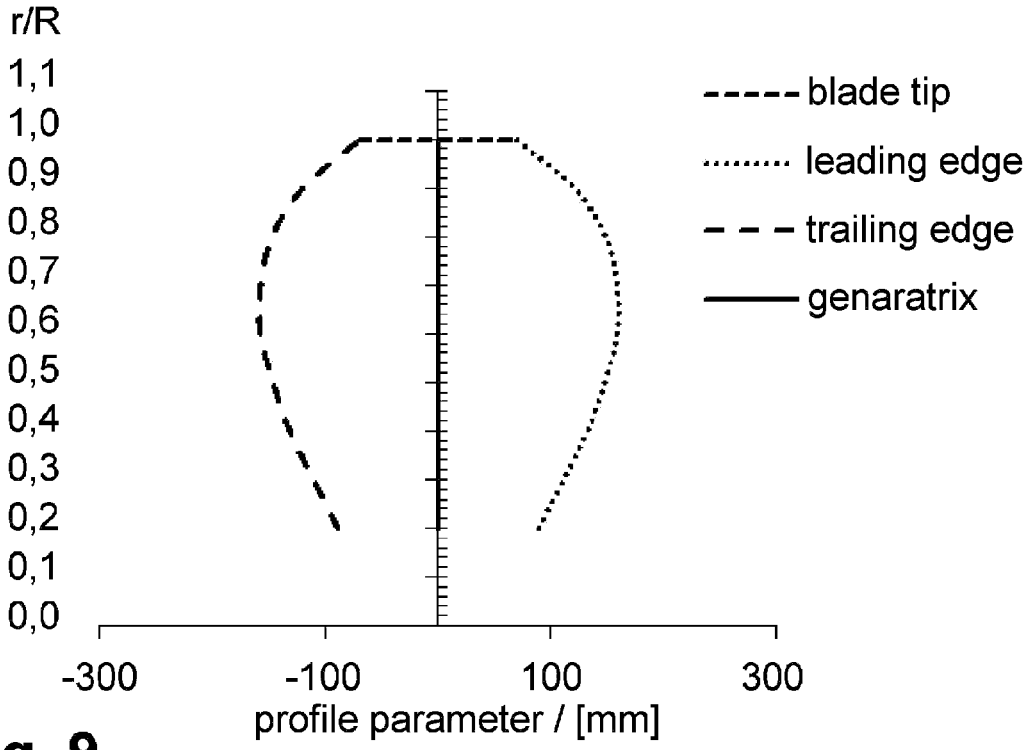
FIG. 9 shows a diagram of the distribution of profile thicknesses and chord lengths in a plan view onto the propeller plane, according to an embodiment of the system described herein.

In a first step, an arbitrary number of radii sections of the blade may be selected, at which the profiles are defined. A radial profile thickness distribution and a profile length distribution may be selected. An exemplary course of the profile thickness and of the chord length versus the radius is illustrated in FIG. 8. These distributions yield, in a plan view without skew, the propeller blade illustrated in FIG. 9. The generatrix of the blade runs straight upward in FIG. 9, and connects the chord center of the blade profiles in the respective radii sections. The chord center coincides with the respective profile center of gravity in the selected profiles. In the case of the distribution of the blade profiles without skew as shown in FIG. 9, the generatrix corresponds to the radial straight line through the root. The dotted line represents the leading edge (L.E.) and the dashed line represents the trailing edge (T.E.).

To shift the position of the blade tips, the following approach is expedient.

In general, use may be made of similar thickness distributions of the blade profiles across all radii sections. The thickness distribution may have a fixed shape factor which indicates what fraction of the product of chord length and maximum profile thickness is covered by the area of the radii section. The area of a profile consequently may be approximated very closely by the product of profile thickness*chord length*shape factor.

Figure 10:
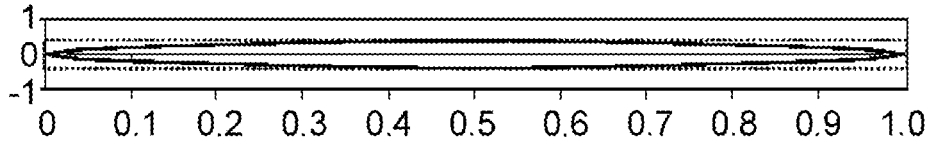
FIG. 10 shows a scaled radii section of a blade profile, according to an embodiment of the system described herein.
Figure 11:
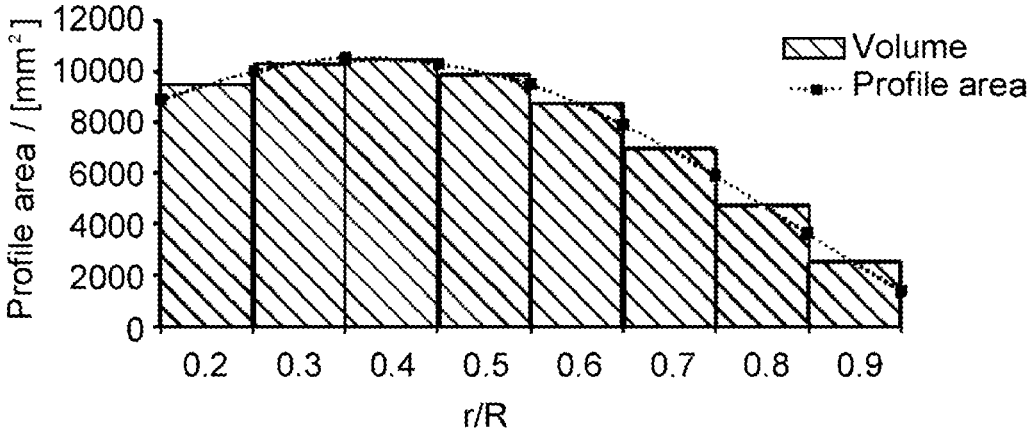
FIG. 11 shows volume elements generated from the profile thicknesses, according to an embodiment of the system described herein.

An example of a course of a scaled profile is schematically illustrated in FIG. 10. Volume elements may be generated from the profile areas in a manner dependent on the radial spacing. The different sizes of these volume elements over the radius of the propeller can be seen in FIG. 11.

These volume elements also correspond to the radial distribution of the percentage fractions in the overall weight of the blade which determine the position of the center of gravity of the blade both in a radial direction and in a circumferential direction. In order to obtain a balanced propeller, all blades should have the same weight, and their centers of gravity should be distributed uniformly over the entire circumference of the propeller.

Figure 12:
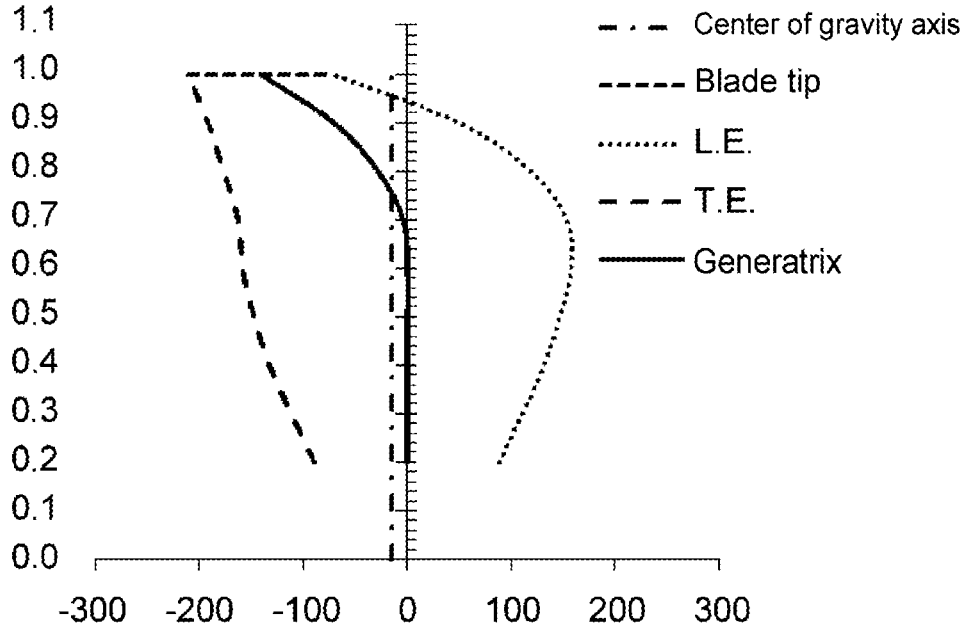
FIG. 12 shows a course of the profile thicknesses and chord lengths with a shift of the profiles in the outer portion of the blade, according to an embodiment of the system described herein.

If the blade tips are shifted counter to the direction of rotation, then the overall center of gravity of the propeller also shifts in the same direction, correspondingly to the percentage fraction of the shifted volume elements. In a first step, the shift of the blade tips for the blades may be selected. The course of the profile thicknesses and chord length with a shift of the profiles in the outer portion of the blade counter to the direction of rotation thereof, that is to say toward the trailing edge (T.E.), is illustrated in FIG. 12.

In the second step, the radially inner radii sections should be shifted in the opposite direction in order to shift the center of gravity again such that it runs through the root (profile center of the profile adjoining the hub). If the initial position of the blade tip from FIG. 9 is to be shifted to the position in FIG. 12, the course of the generatrix in the region from 0.2 to 0.7 of the propeller radius should be shifted in the direction of rotation, that is to say toward the leading edge (L.E.), until the center of gravity lies at 0 again, that is to say passes through the root.

Figure 13:
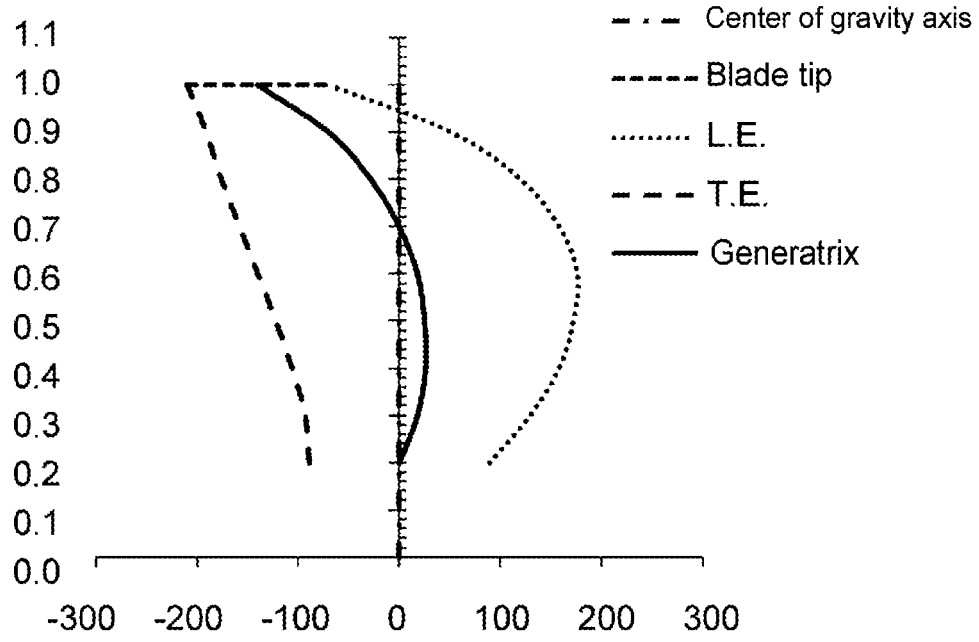
FIG. 13 shows a course of the profile thicknesses and chord lengths with a shift of the profiles over the entire blade extent, according to an embodiment of the system described herein.

This course of the generatrix is illustrated in FIG. 13. In the case of large contour gradients, it must be observed that the number of supporting points must be selected to be correspondingly high.

2. Establishing the Axial Balance

Figure 14:
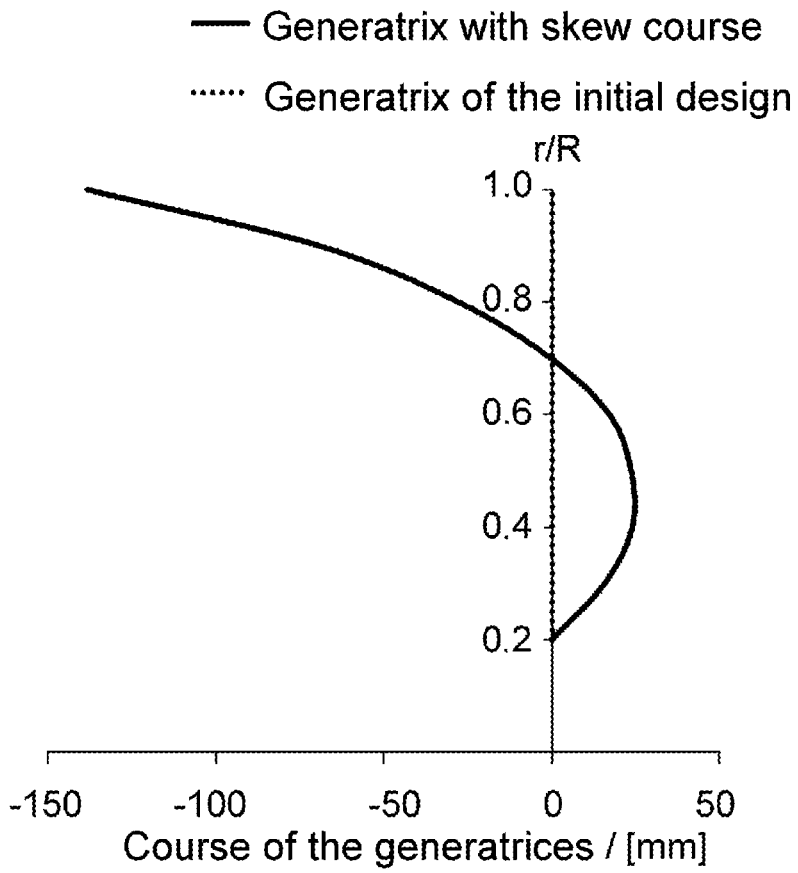
FIG. 14 shows a comparison of the generatrix with skew with the course of the generatrix of the initial design, according to an embodiment of the system described herein.

For this purpose, according to Carlton (l.c., chapter 3.4, pages 33-35), the blade rake attributable to the blade skew (skew induced rake) is calculated and is plotted negatively as a rake. FIG. 14 shows a comparison of the generatrix with skew course with the course of the generatrix of the initial design of the blade profile.

The features of the system described herein disclosed in the present description, in the drawings and in the claims may be both individually and combinatively essential to the realization of the invention in its various embodiments. The invention is not restricted to the described embodiments. It may be varied within the scope of the claims and taking into consideration the knowledge of a person of relevant skill in the art. Other embodiments of the system described herein will be apparent to those skilled in the art from a consideration of the specification and/or an attempt to put into practice the system described herein disclosed herein. It is intended that the specification and examples be considered as illustrative only, with the true scope and spirit of the invention being indicated by the following claims.

The invention claimed is:

1. A propeller for a watercraft, comprising:

a hub; and at least two blades that extend from the hub in an outward radial direction in a uniform blade separation at the hub, wherein angular spacing between roots of successive blades is identical for all blades, wherein centers of mass of the at least two blades in relation to the hub have a same radial spacing to the hub, and/or the at least two blades have a same weight, and wherein a first angular spacing between blade tips of a first one of the at least two blades and a successive blade of the at least two blades varies in relation to a second angular spacing between blade tips of a second one of the at least two blades and a successive blade of the at least two blades.

2. The propeller as claimed in claim 1, wherein the at least two blades of the propeller have a different course of blade skew.

3. The propeller as claimed in claim 1, wherein a course of a generatrix of one of the at least two blades deviates from a course of a generatrix of an other one of the at least two blades.

4. The propeller as claimed in claim 1, wherein the at least two blades have different extents in a radial direction.

5. The propeller as claimed in claim 1, wherein a pitch course of one of the at least two blades deviates from a pitch course of an other one of the at least two blades.

6. The propeller as claimed in claim 1 wherein, in the case of an even number of blades and at least four blades, in each case two diametrically oppositely situated blades are of identical form.

7. The propeller as claimed in claim 1, wherein centers of mass of the at least two blades lie in a same axial plane in relation to the hub.

8. The propeller as claimed in claim 7, wherein a course of a blade rake is adapted to a course of blade skew.

9. The propeller as claimed in claim 1, wherein a length of the generatrix in a radial direction of one of the at least two blades deviates from a length of the generatrix of an other one of the at least two blades.

10. The propeller as claimed in claim 1, wherein a spacing of blade tips of two successive blades of the at least two blades is selected such that, at a design point, pressure pulses generated by the blade tips counteract excitation of a hull of the watercraft by pressure pulses of upstream blade tips.

11. A propeller for a watercraft, comprising:

a hub; and at least two blades that extend from the hub in an outward radial direction in a uniform blade separation at the hub, wherein angular spacing between roots of successive blades is identical for all blades, and wherein a first angular spacing between blade tips of a first one of the at least two blades and a successive blade of the at least two blades varies in relation to a second angular spacing between blade tips of a second one of the at least two blades and a successive blade of the at least two blades.

12. The propeller according to claim 11, wherein centers of mass of the at least two blades in relation to the hub have a same radial spacing to the hub and/or the at least two blades have a same weight.

13. The propeller as claimed in claim 11, wherein at least two of the at least two blades have a different course of blade skew.

14. The propeller as claimed in claim 11, wherein a course of a generatrix of a first blade of the at least two blades deviates from a course of a generatrix of at least one further blade of the at least two blades.

15. The propeller as claimed in claim 11, wherein a pitch course of one of the at least two blades deviates from a pitch course of an other one of the at least two blades.

16. A watercraft, comprising:

a propeller including a hub and at least two blades that extend from the hub in an outward radial direction in a uniform blade separation at the hub, wherein angular spacing between roots of successive blades is identical for all blades, and wherein a first angular spacing between blade tips of a first one of the at least two blades and a successive blade of the at least two blades varies in relation to a second angular spacing between blade tips of a second one of the at least two blades and a successive blade of the at least two blades.

17. The watercraft according to claim 16, wherein centers of mass of the at least two blades in relation to the hub have a same radial spacing to the hub and/or the at least two blades have a same weight.

18. The watercraft as claimed in claim 16, wherein at least two of the at least two blades have a different course of blade skew.

19. The watercraft as claimed in claim 16, wherein a course of a generatrix of a first blade of the at least two blades deviates from a course of a generatrix of at least one further blade of the at least two blades.

20. The watercraft as claimed in claim 16, wherein a pitch course of one of the at least two blades deviates from a pitch course of an other one of the at least two blades.

* * * * *